US007553104B2

(12) United States Patent
Nordhoff

(10) Patent No.: US 7,553,104 B2
(45) Date of Patent: Jun. 30, 2009

(54) SYNTHETIC MATERIALS FOR WATER DRAINAGE SYSTEMS

(76) Inventor: Scott Nordhoff, 1008 16th St., Bedford, IN (US) 47421

( * ) Notice: Subject to any disclaimer, the term of this patent is extended or adjusted under 35 U.S.C. 154(b) by 466 days.

(21) Appl. No.: 11/409,386

(22) Filed: Apr. 21, 2006

(65) Prior Publication Data

US 2007/0092338 A1 Apr. 26, 2007

Related U.S. Application Data

(63) Continuation-in-part of application No. 11/258,252, filed on Oct. 25, 2005.

(51) Int. Cl.
*E04F 17/00* (2006.01)
*B44F 7/00* (2006.01)

(52) U.S. Cl. ..... 405/43; 405/36; 52/302.1; 428/15; 428/358

(58) Field of Classification Search ..... 405/45, 405/302.4, 302.6, 36, 43; 428/15, 358; 52/169.5, 52/302.1, 302.4, 302.6
See application file for complete search history.

(56) References Cited

U.S. PATENT DOCUMENTS 2,795,542 A 6/1957 Horne et al.
3,570,253 A 3/1971 Vidal
3,785,842 A * 1/1974 Murray ..... 106/457
3,933,546 A 1/1976 Gohda et al.
3,975,467 A 8/1976 Beck
4,136,500 A 1/1979 DiFiore
4,185,429 A 1/1980 Mendola
4,290,252 A 9/1981 Demirel et al.
4,612,742 A 9/1986 Bevilacqua
4,869,032 A 9/1989 Geske
4,877,350 A 10/1989 DiFiore
4,923,331 A 5/1990 Kreikemeier
4,943,185 A 7/1990 McGuckin et al.
5,105,577 A 4/1992 Hedges
5,248,226 A 9/1993 Rose
5,444,950 A 8/1995 Kelly et al.
5,765,323 A 6/1998 Bevilacqua
5,836,135 A 11/1998 Hagan et al.
5,845,458 A 12/1998 Read
5,931,603 A 8/1999 Swain et al.
5,934,828 A 8/1999 Hu et al.

(Continued)

OTHER PUBLICATIONS

Pit & Quarry—Equipment-Operations-Solutions; Synthetic aggregate, Jul. 1, 2005 By David Shulman.

(Continued)

*Primary Examiner*—Tara Mayo-Pinnock
(74) *Attorney, Agent, or Firm*—Woodard, Emhardt, Moriarty, McNett & Henry LLP

(57) ABSTRACT

Synthetic rocks are used as a substitute for natural gravel to fill in a water drainage trench. The synthetic rocks may be used around perforated drain tiles in a basement water drainage system, or they may be used without such tile. The synthetic rocks may be of a size and shape that mimics the natural rock they replace, but they are preferably significantly lighter in weight. The synthetic rocks may alternatively be tubular or cubic shaped, for example, and may include one or more lumens or other passageways to facilitate the flow of water through and/or around the rocks. The synthetic rocks may be provided in mesh bags to facilitate placement in a water drainage trench.

4 Claims, 12 Drawing Sheets

U.S. PATENT DOCUMENTS

| | | | |
|---|---|---|---|
| 6,095,718 | A | 8/2000 | Bohnhoff |
| 6,145,260 | A | 11/2000 | Morton |
| 6,230,468 | B1 | 5/2001 | Klaus |
| 6,279,275 | B1 | 8/2001 | Sawyer |
| 6,550,190 | B2 | 4/2003 | Ruiz et al. |
| 6,632,882 | B2 | 10/2003 | Gaveske |
| 6,634,144 | B1 | 10/2003 | Moore et al. |
| 6,821,424 | B1 * | 11/2004 | Branz ..... 210/605 |
| 6,905,289 | B1 | 6/2005 | Sanguinetti |

OTHER PUBLICATIONS

Better Roads—For the Government/Contractor Project Team; Jun. 2005; Synthetic Aggregates Promise New Options for Engineers by Tom Kuennen.

* cited by examiner

SYNTHETIC MATERIALS FOR WATER DRAINAGE SYSTEMS

CROSS REFERENCE TO RELATED APPLICATION

This application is a continuation-in-part of U.S. patent application Ser. No. 11/258,252, filed Oct. 25, 2005, which is hereby incorporated herein by reference in its entirety.

FIELD OF THE INVENTION

The present invention relates generally to materials and methods for use in water drainage systems.

BACKGROUND TO THE INVENTION

The use of drainage trenches to direct water away from a building, and thus to prevent water from seeping into the building, has been known for many years. In some cases perforated or slotted drain tiles are used in the trenches, with the trench being provided around the inside and/or outside perimeter of a building to form a pipe line which relieves hydrostatic pressure by collecting and diverting water away from the building, such as to a sump pump or a drainage field. Such systems are frequently referred to as French drain tile systems.

The drain tiles typically comprise perforated or slotted pipe sections with sufficient perforations or slots to collect and divert water. The tiles are used to at least partially fill the trench and keep dirt and debris from filling the trench and restricting the flow of water. The tiles may also help support a covering material, such as concrete or another flooring material.

In some cases the tiles are positioned in a bed of river rock, gravel or crushed stone (referred to collectively in this disclosure as natural gravel, rock, or stone), which allows water to flow into the tiles and keeps dirt from clogging the perforations/slots. The gravel also provides a supporting substrate for concrete, etc., that may be added to cover the drain tiles from above.

In other water drainage systems gravel may be used to facilitate water flow even when perforated drain tiles are not used. In such systems another channel material may be used, or the trench may be filled only with gravel.

While the use of gravel to surround the drain tile provides advantages in terms of allowing good water flow and the ability to hold the tile in place, it also has disadvantages. For example, because the amount of gravel used in a particular job is large, heavy equipment such as dump trucks and front loaders are generally required to transport and handle the stone. In addition, transporting the gravel around the job site (e.g., into a basement) requires substantial physical labor and adds significant cost to the job.

Similarly, the use of gravel in tile-free systems also has disadvantages, including difficulty in transporting, storing, and using the gravel, as well as its propensity for introducing dirt or other contaminants to the drain area.

A need therefore exists for materials and methods for use in water drainage systems when it is desired to avoid the disadvantages of natural gravel. The present invention addresses that need.

SUMMARY OF THE INVENTION

Briefly describing one aspect of the present invention, there is provided a method of facilitating the flow of water in a water drainage system by providing a water flow path that is at least partly filled with a lightweight, synthetic filler material such as synthetic rocks. In another aspect of the invention a synthetic filler material is used to fill in around perforated drain tiles in a water removal system. The synthetic filler material may comprise a plurality of individual pieces that optionally include one or more passageways therethrough to facilitate the flow of water through the material. Relatively large numbers of the synthetic filler pieces may be enclosed in mesh bags to facilitate the handling of the material.

DETAILED DESCRIPTION OF THE INVENTION

Figure 1:
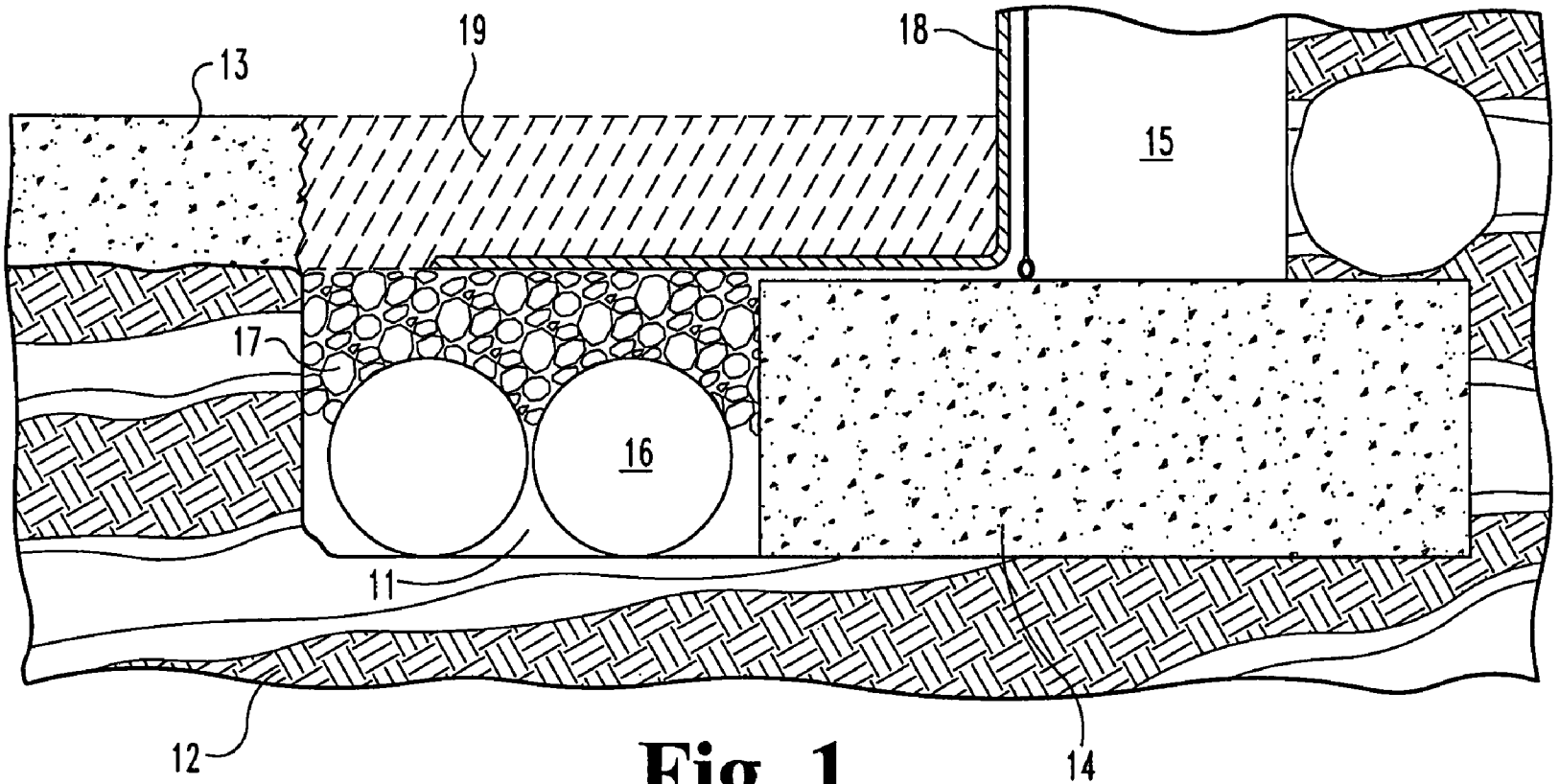
FIG. 1 shows one embodiment of a drainage trench with synthetic rock and perforated tile.

For the purposes of promoting an understanding of the principles of the invention, reference will now be made to certain embodiments and specific language will be used to describe the same. It will nevertheless be understood that no limitation of the scope of the invention is thereby intended, such alterations and further modifications of the illustrated embodiments being contemplated as would normally occur to one skilled in the art to which the invention relates.

As indicated above, one aspect of the present invention relates to the use of lightweight, synthetic rocks or pellets to fill in around a length of perforated drainage tile. In one preferred embodiment, the drain tile is being used in a basement waterproofing system. The synthetic rocks support the drainage tile in a manner in which water is free to flow into the tile. In the preferred embodiment mentioned above, the synthetic rocks also provide a substrate on which, for example, concrete may be poured to repair the floor. The synthetic rocks function much as natural rock would in a similar environment, but are far easier to transport and install.

In another aspect of the invention synthetic rocks appropriate for use in water drainage systems are provided. Such rocks may be sized and shaped to at least partially fill a drainage trench without unduly restricting the flow of water through the trench. In other aspects the rocks may be sized and shaped to fill in around perforated drain tile. The synthetic rocks of the present invention may include one or more openings or passageways to facilitate the flow of water through a bed of the rocks.

In another aspect of the present invention, synthetic rocks are used to at least partially fill in a water flow path without unduly restricting the flow of water through the path. In such cases the synthetic rocks may support concrete or another covering material, while still allowing the free flow of water through the system. The method is particularly useful for covered water drainage systems.

As to the synthetic rocks that may be used in one or more aspects of the invention, the synthetic rocks may be of substantially any shape and size effective to fill in around a drainage tile, although synthetic rocks that simulate natural gravel are preferred for certain applications. In some preferred embodiments the synthetic rocks may be tubular shaped, such as is shown in FIGS. 13 through 16. Such tubular members may be referred to as mini-tubes. Synthetic rocks of different shapes and/or sizes may be used together, and in some cases synthetic rocks may be used with natural rock. The synthetic rocks may function as a filler material to fill in around drainage tiles and to facilitate the flow of water into and through the tiles.

In some embodiments the synthetic rocks are generally tubular, while in other embodiments the synthetic rocks are cubic or pyramidal shaped. In some embodiments the synthetic rocks are irregularly shaped, much as natural rock is. The synthetic rocks need not replicate the look of natural rock, so long as the synthetic material can function generally as natural rock would when used to fill in around train tiles.

In some embodiments the synthetic rocks have at least one hole (which may be referred to as an opening, an aperture, or a lumen) extending through the rock to permit water to flow through, and not just around, the rock. In some preferred embodiments two, three or more holes are provided through the synthetic rocks. In other embodiments the synthetic rocks have other passageways or open spaces to facilitate the flow of water around and/or through the rock.

In some preferred embodiments the largest dimension of the synthetic rocks is less than 2 inches, more preferably between 0.5 inches and 1.5 inches, and most preferably between 0.75 inches and 1.25 inches. In other preferred embodiments the synthetic rocks have a largest dimension of less than 3 inches, more preferably between 0.5 and 2.5 inches, and most preferably between 1.0 and 2.0 inches. In other embodiments the largest dimension of the synthetic rocks is greater than 3 inches.

The synthetic rocks of the present invention are generally described as being "lightweight" because they are typically lighter than the natural rock they replace. In some embodiments though, it is desired that the synthetic rocks are heavy enough not to float in water, so that they are more stable when used in a water flow path like a drainage trench. In other embodiments it is desired to select and/or use synthetic rocks that are "matched" to the flow characteristics of a particular water flow path, i.e., to select synthetic rocks having a specific gravity that is effective for use in a particular water flow path. For example, it may be desired to select synthetic rocks having a higher specific gravity for use in systems with a faster water flow, and to select synthetic rocks having a lower specific gravity for use in systems with a slower water flow.

In some embodiments the synthetic rocks have a specific gravity of less than 3.0, while in other embodiments the specific gravity is between 1.0 and 3.0 or is between 1.0 and 2.0. In other embodiments, the synthetic rocks have a specific gravity of less than about 2.0, and alternatively a specific gravity of less than about 1.5. In still other embodiments, the synthetic rocks have a specific gravity of less than 1.0.

It is to be appreciated that the term "synthetic rock" as used herein refers to synthetic pieces of any type that may be used to replace a natural rock-like material in a water flow path—regardless of whether the synthetic piece closely mimics the shape of any natural material, and regardless of whether any natural material that is mimicked would be referred to as a rock or a pellet or a stone, or some other name. No distinction is intended between synthetic rocks and synthetic pellets or synthetic stones or synthetic gravel, etc. All such materials are intended to be included in the term synthetic rock.

Similarly, the synthetic pieces need not closely mimic the size and/or shape of any natural material, with synthetic pieces that are generally tubular in shape being particularly preferred for some applications.

The synthetic rocks may be made of any one or a combination of synthetic materials, and different materials may be used together in a single application. In general though, the synthetic rocks are made of a material that is lightweight, yet strong enough to substitute for natural gravel in waterproofing applications. Examples of synthetic materials include, but are not limited to, polyethylenes, polypropylenes, polystyrenes, polyvinyl chlorides, polyurethanes, polycarbonates, acrylics, polyethylene terephthalates, polyamides, polyesters, acrylonitrile butadiene styrenes, polyvinylidene chlorides, synthetic rubbers, etc.

In some embodiments the synthetic rocks are made of a material that does not absorb or retain water, and thereby keeps a drainage space, such as a crawl space, cleaner and less humid that comparable spaces in which natural rock or gravel is used.

The synthetic rocks of the present invention may be used with drain tile, as indicated above. The drain tile may be perforated or slotted drain tile such as is conventionally used in basement waterproofing applications. Drain tile diameters are typically between about 2 and 6 inches in diameter, and preferably about 4 inches in diameter, although larger or smaller drainpipes may be used. While drain tiles are commonly referred to as perforated or slotted, the tiles may have opening of virtually any size and shape effective for allowing water to enter radially and flow through the tile. Moreover, the opening may be dispersed around the tile, or they may be concentrated on only one or more sides, such as on the top portion of the tile when the tile is laid in a drainage trench.

For the purposes of this disclosure, the term "perforated drain tile" is understood to refer generally to all drain tiles, pipes, tubes, channels, etc., having perforations, slots, or other openings that allow water to flow into the tile. Also, in this disclosure perforated drain tile may alternatively be referred to as perforated drainpipe.

It is also to be appreciated that the term drain tile as used herein refers to any drain tile, pipe, channel, or tubing that may be used to direct a flow of water, such as in basement waterproofing applications. The drain tile, pipe or channel may be rigid or it may be flexible, and it may be provided in substantially any length and diameter appropriate for a particular application. The tile may have substantially any cross-sectional shape, such as circular, rectangular, triangular, or an irregular shape.

To illustrate one method for practicing the invention, a drainage trench (alternatively referred to as a drainage channel or a drainage pathway) may be dug below the floor around the inside perimeter of a building. Alternatively, a channel or trench may be provided around the outside perimeter of a building, or at other location desired to be protected from water. As is known to the art, when a trench is dug inside an existing structure it is common that a portion of the existing floor (generally concrete) will first need to be removed.

The trench may be of substantially any dimensions, but is commonly about 6-18 inches deep and 6-18 inches wide, most commonly about 12 inches deep and 12 inches wide. The length is generally determined by the size of the area to be protected. In most cases the trench is dug to a depth near, but not below, the depth of the bottom of the building foundation.

The drainpipe is laid in the trench. One, two, or more lengths of drain tile may be laid adjacent to or on top of each other.

In some embodiments the drainpipe may be laid on top of a base layer of synthetic gravel. When a base layer of synthetic gravel is used, the base layer is typically between 1 and 4 inches in depth.

Pins, nails, brackets, etc., may be used to hold the drainpipe in place.

Additional synthetic rock may be provided on top of and around the drainpipe. This top layer of synthetic gravel may comprise the same synthetic gravel that was used in the base layer (if a base layer was used), or it may be different. The top layer is typically provided so that it fills in around the drainpipe. The top layer may also cover the drainpipe, most commonly to a depth of 1 to 4 inches.

Concrete or other solid flooring material may then be provided over the synthetic rock to provide an appropriate floor. The concrete is preferably poured to a depth of at least three or four inches.

Referring now to the drawings, FIG. 1 shows one embodiment of a drainage trench with synthetic rock and perforated tile, as disclosed in one aspect of the present invention. Trench 11 is provided in soil 12 after removing a portion of concrete floor 13. In the illustrated embodiment trench 11 is adjacent footer 14 which supports foundation wall 15. Two lengths of perforated drain tile 16 are provided in trench 11. Synthetic rocks 17 are provided over drain tile 16. A section of vinyl Cove Mold 18 overlays at least a portion of synthetic rocks 17. Replacement concrete floor 19 is provided over synthetic rocks 17 and over vinyl cove mold 18.

Figure 2:
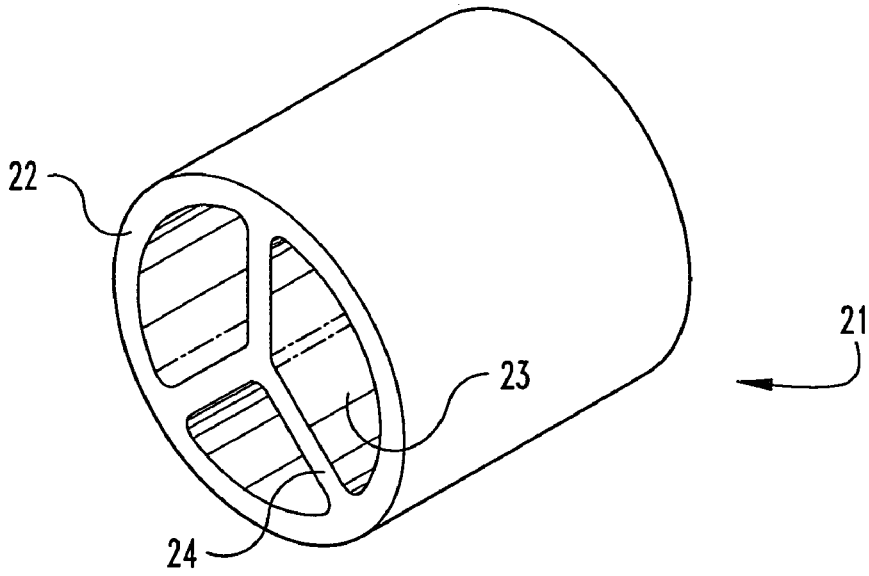
FIG. 2 shows one embodiment of a synthetic rock that may be used in the methods of the present invention.

FIG. 2 shows one embodiment of a synthetic rock appropriate for use in the present invention. Synthetic rock 20 includes side wall 22 and interior walls 24 defining passageways 23 through the rock. The dimensions of the illustrated embodiment may vary depending on the desired use, but generally in one preferred embodiment the diameter "d" of the rock is between 0.5 inches and 2.0 inches and the length "l " of the rock is a similar size. The largest dimension of such rocks is therefore between about 0.5 inches and about 3 inches, with the largest dimension preferably being between about 0.7 inches and about 1.5 inches.

Figure 3:
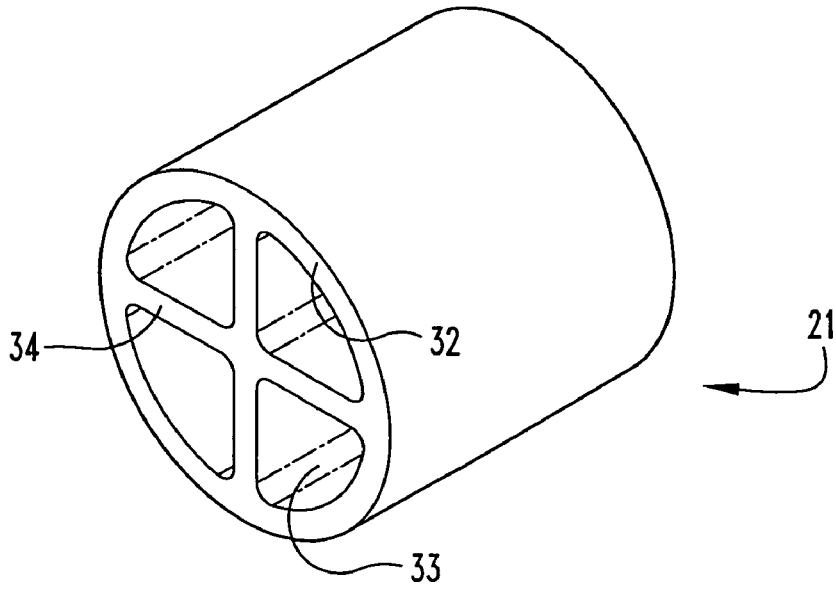
FIG. 3 shows another embodiment of the synthetic rocks that may be used in the methods of the present invention.

FIG. 3 shows one embodiment of a synthetic rock appropriate for use in the present invention. Synthetic rock 30 includes side wall 32 and interior walls 34 defining passageways 33 through the rock.

Figure 4:
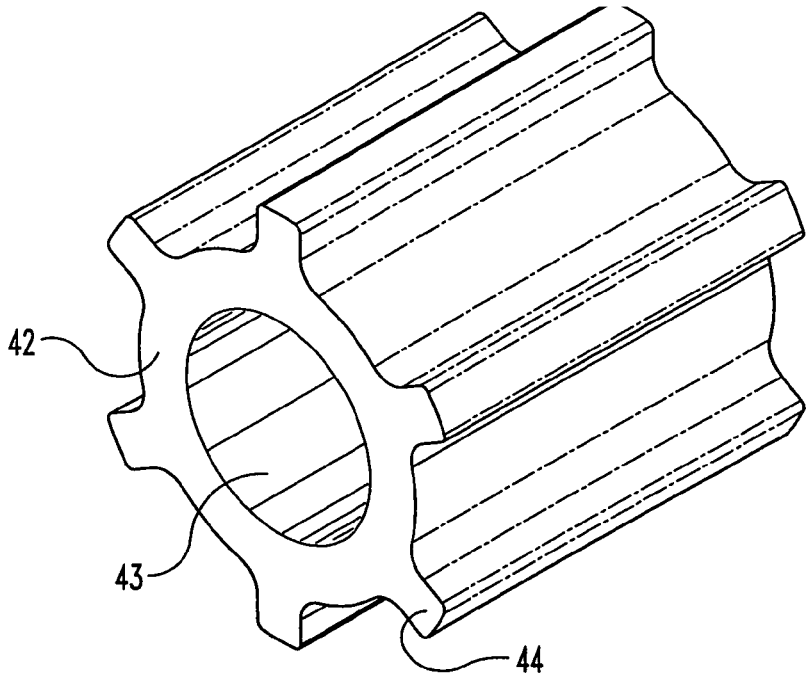
FIG. 4 shows another embodiment of the synthetic rocks that may be used in the methods of the present invention.

FIG. 4 shows one embodiment of a synthetic rock appropriate for use in the present invention. Synthetic rock 40 includes side wall 42 and interior walls 44 defining passageways 43 through the rock.

Figure 5:
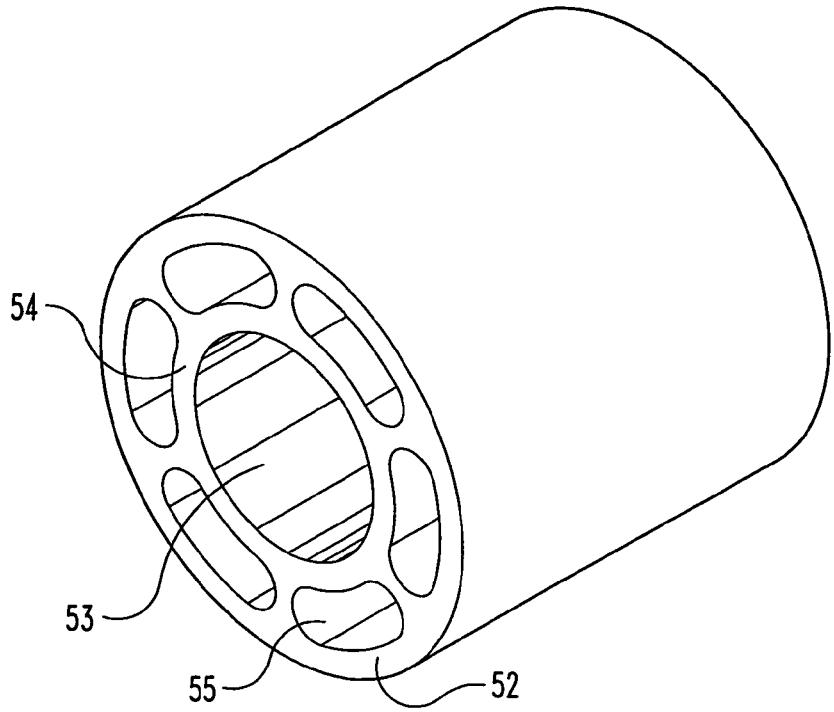
FIG. 5 shows another embodiment of the synthetic rocks that may be used in the methods of the present invention.

FIG. 5 shows one embodiment of a synthetic rock appropriate for use in the present invention. Synthetic rock 50 includes side wall 52 and interior walls 54 defining passageways 53 and 55 through the rock.

Figure 6:
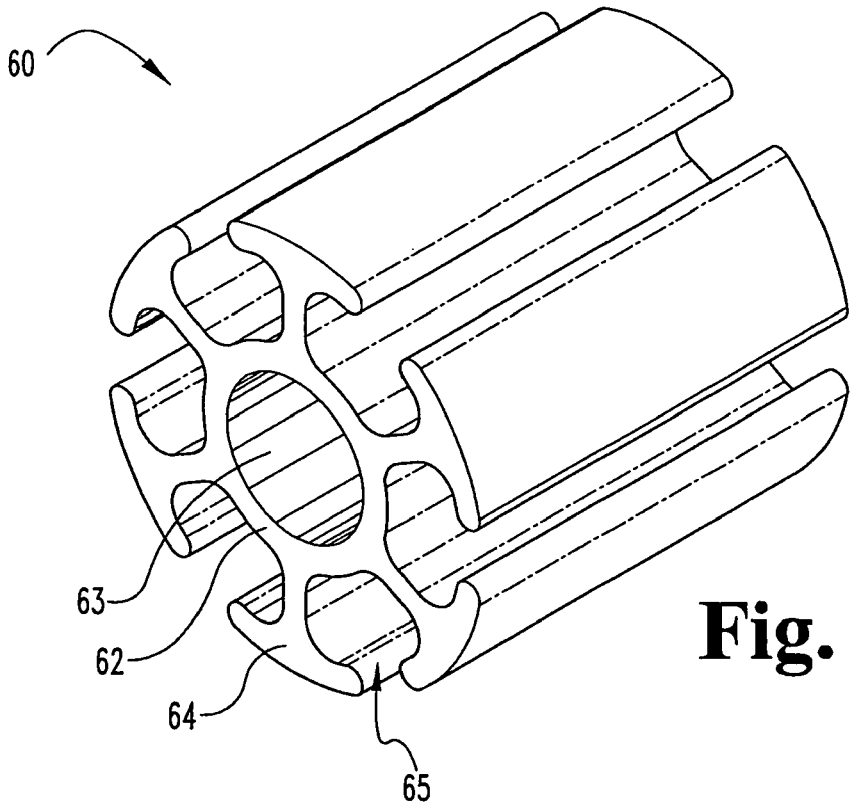
FIG. 6 shows another embodiment of the synthetic rocks that may be used in the methods of the present invention.

FIG. 6 shows another embodiment of a synthetic rock appropriate for use in the present invention. Synthetic rock 60 includes side walls 64 and interior walls 62 defining passageways 63 and 65 through the rock.

Figure 7:
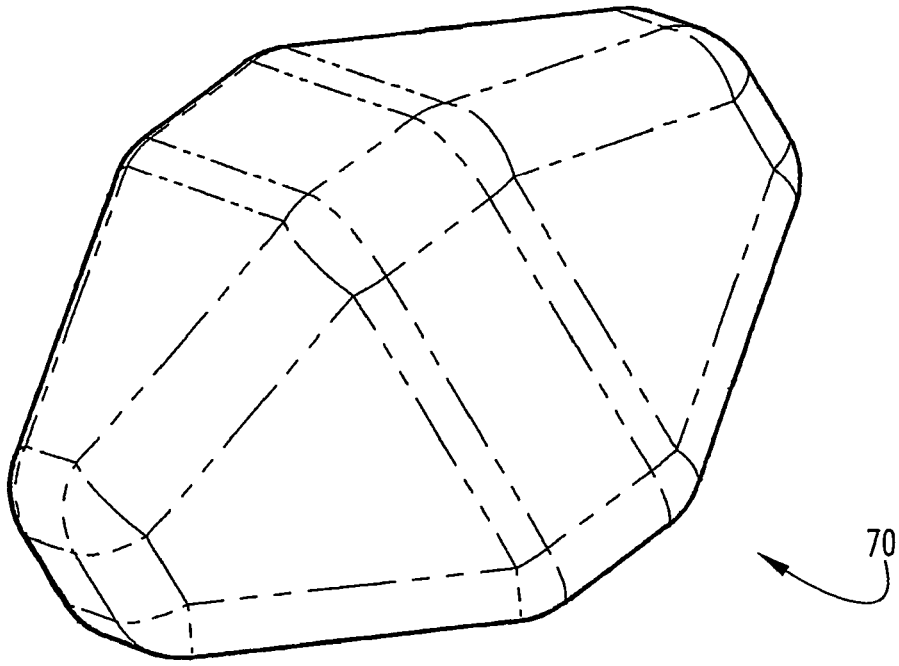
FIG. 7 shows another embodiment of the synthetic rocks that may be used in the methods of the present invention.

FIG. 7 shows another embodiment of a synthetic rock appropriate for use in the present invention. Synthetic rock 70 includes a combination of rectangular and/or triangular and/or trapezoidal walls defining a shell that may or may not include passageways through the rock.

Figure 8:
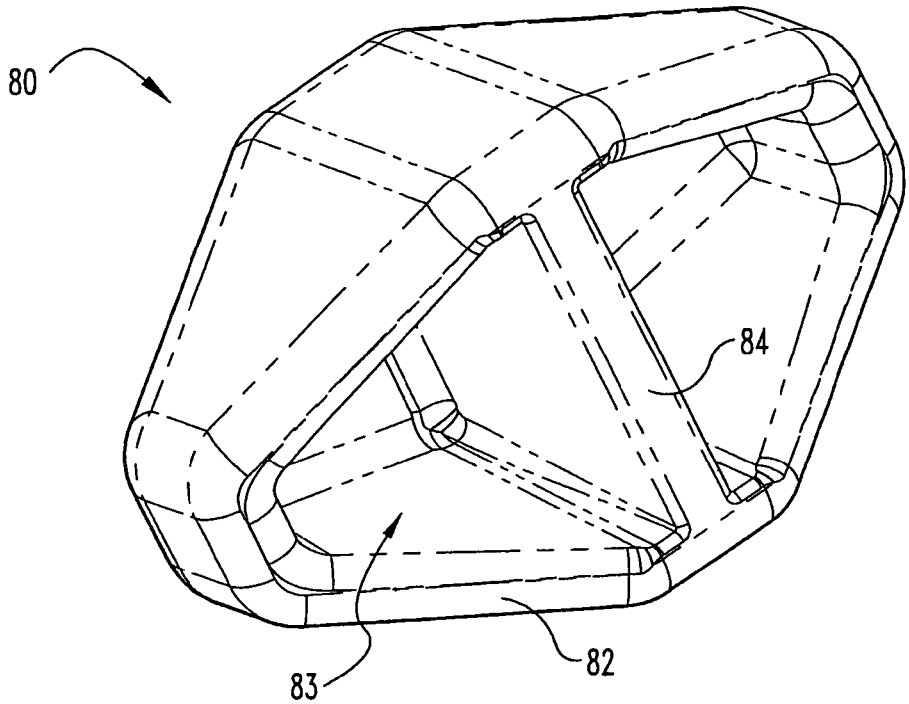
FIG. 8 shows another embodiment of the synthetic rocks that may be used in the methods of the present invention.

FIG. 8 shows another embodiment of a synthetic rock appropriate for use in the present invention. Synthetic rock 80 again includes a combination of rectangular and/or triangular and/or trapezoidal walls 82 cooperating with inner wall 84 to define passageways 83 through the rock.

Figure 9:
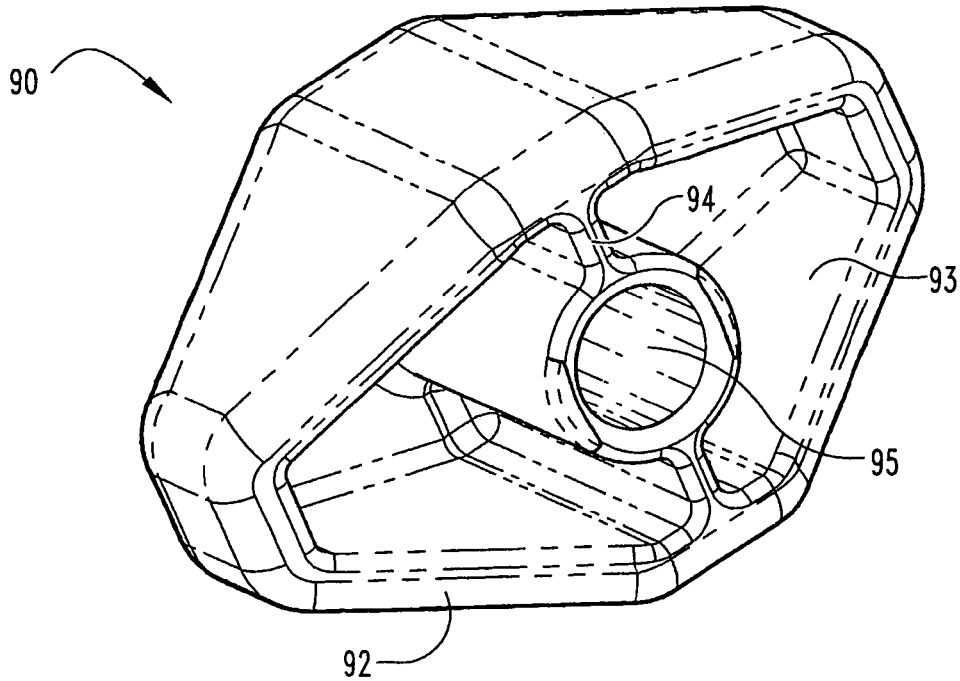
FIG. 9 shows another embodiment of the synthetic rocks that may be used in the methods of the present invention.

FIG. 9 shows another embodiment of a synthetic rock appropriate for use in the present invention. Synthetic rock 90 again includes a combination of rectangular and/or triangular and/or trapezoidal walls 92 cooperating with inner wall 94 to define passageways 93 and 95 through the rock.

Figure 10:
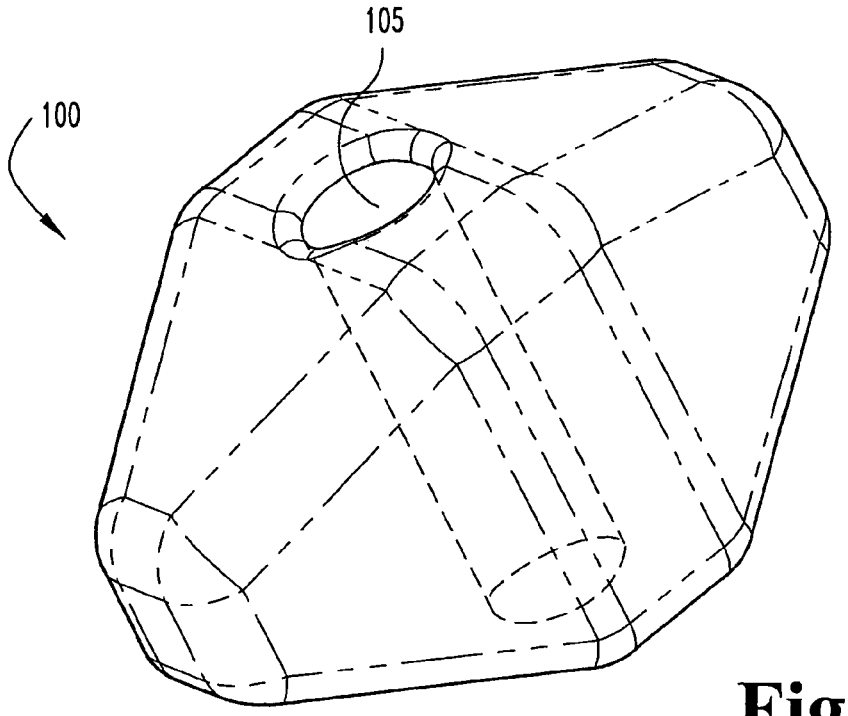
FIG. 10 shows another embodiment of the synthetic rocks that may be used in the methods of the present invention.

FIG. 10 shows another embodiment of a synthetic rock appropriate for use in the present invention. Synthetic rock 100 again includes a combination of rectangular and triangular and/or trapezoidal walls cooperating with an inner wall to define a passageway 105 through the rock.

Figure 11B:
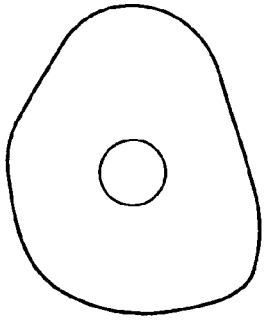
FIG. 11 shows another embodiment of the synthetic rocks that may be used in the methods of the present invention.
Figure 11A:
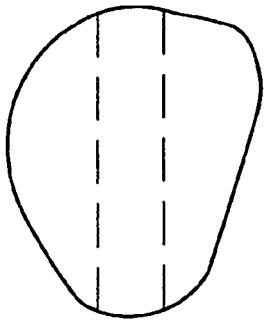

FIGS. 11A and 11B illustrate another embodiment of a synthetic rock appropriate for use in the present invention. The synthetic rock includes irregular shaped walls which may cooperate with an inner wall to define a passageway through the rock.

Figure 12:
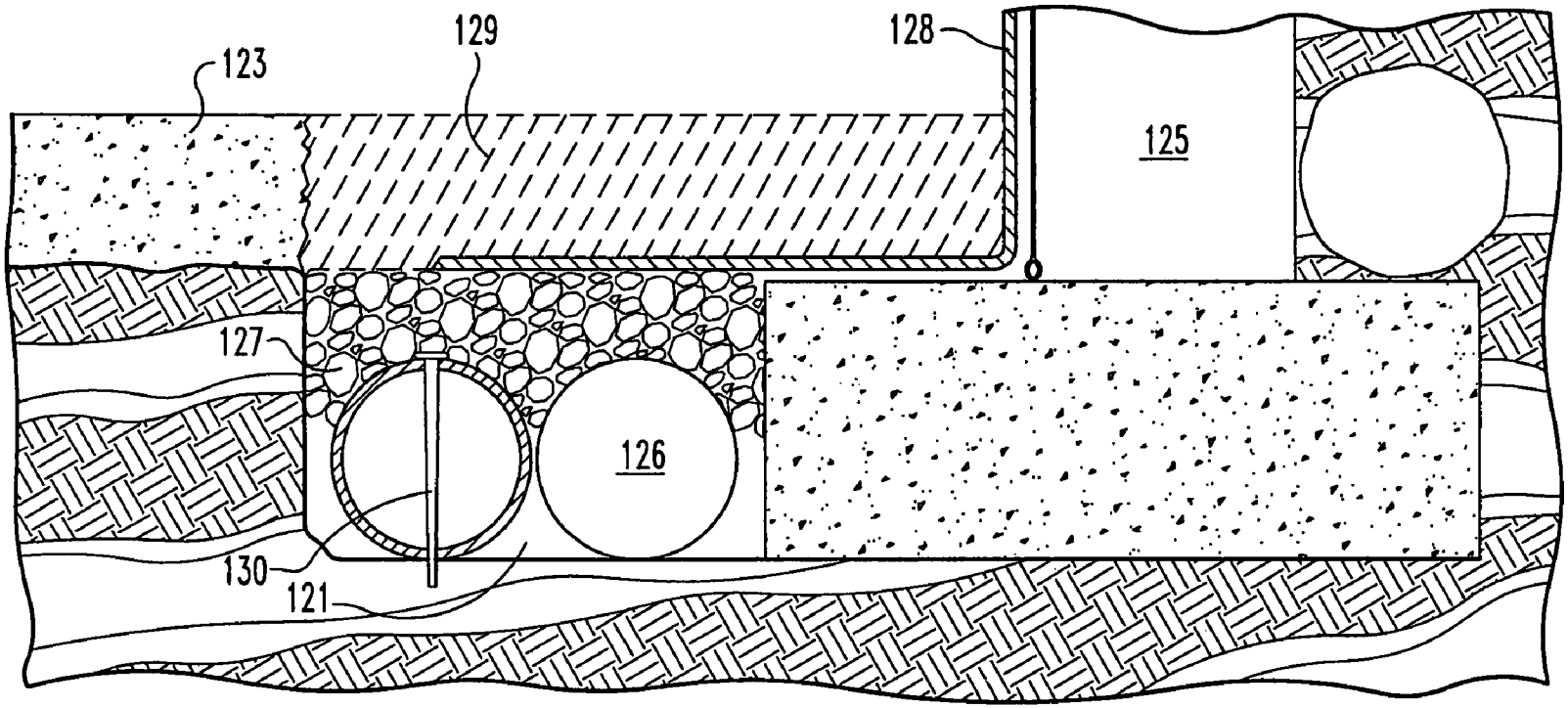
FIG. 12 illustrates one method of providing a drainage trench with synthetic rock and perforated tile.

Illustrating now one method of practicing the present invention, as shown in FIG. 12 a drainage trench 121 may be dug below the floor 123 around the inside perimeter of a building 125. A portion of the existing concrete floor 123 has been removed. The illustrated trench is about 12 inches deep and 12 inches wide.

One or two courses of drainpipe 126 may be laid in the trench. Additional lengths of drain tile may be laid end-to-end to connect the various pieces of drainpipe if necessary, or fewer, longer pieces of drainpipe may be used. Pins or nails 130 may be used to hold the drainpipe in place. This is particularly helpful if the drain tile is a longer piece of lightweight plastic, and if the drain pipe is to be bent around corners, etc.

Synthetic rock 127 may then be provided on top of and around the drainpipe, preferably filling in around the drainpipe. The illustrated layer of synthetic rock covers the drainpipe to a depth of about 3 or 4 inches.

A semi-rigid supporting layer such as Cove Mold 128 may be used to overlay at least a part of the synthetic rock. Concrete or other solid flooring material 129 may then be provided over the synthetic rock to provide an appropriate floor. The concrete is preferably poured to a depth of at least three or four inches.

Figure 13:
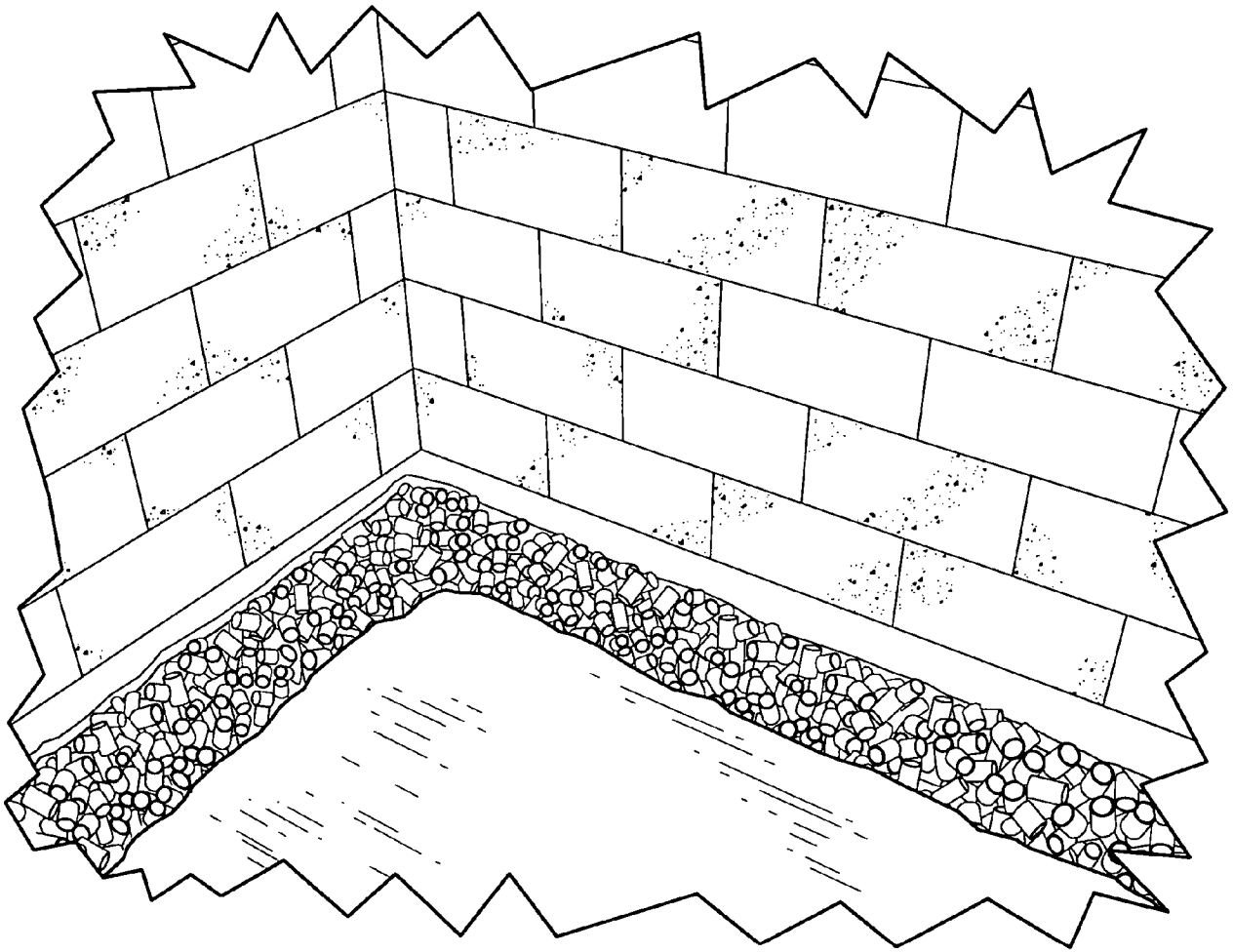
FIG. 13 shows one method of using synthetic rocks to replace natural rock to fill in around drainage tile.

FIG. 13 shows a drainage trench with a portion of the trench being filled with drainpipe and natural rock, and a portion of the trench being filled with drainpipe and synthetic rock. As can be seen from the illustration, the synthetic rock performs at least as well, while providing the advantages of being significantly easier to transport and install.

Figure 14:
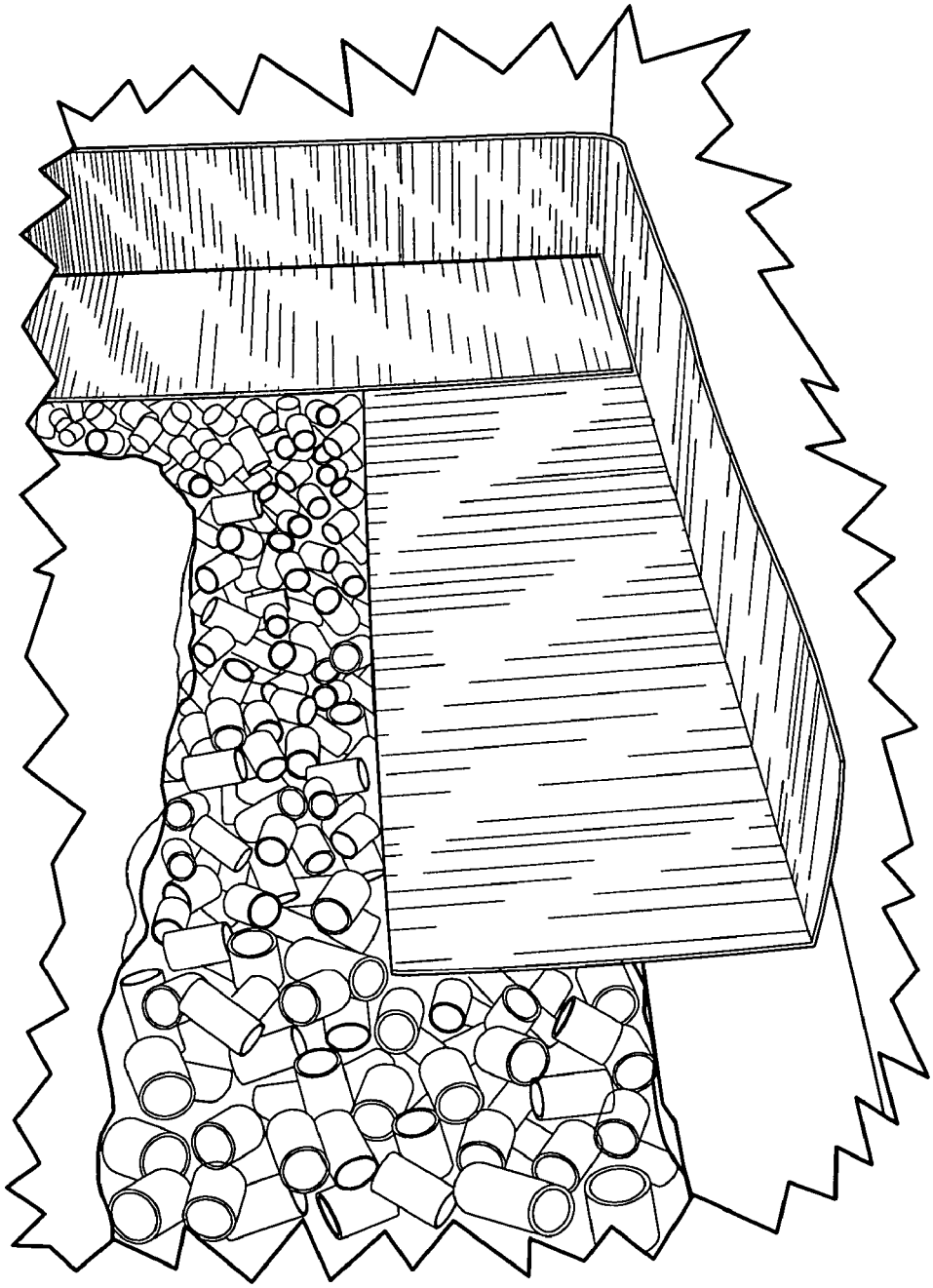
FIG. 14 shows a section of semi-rigid material overlaying synthetic rock surrounding drain tile in one embodiment of the present invention.
Figure 15:
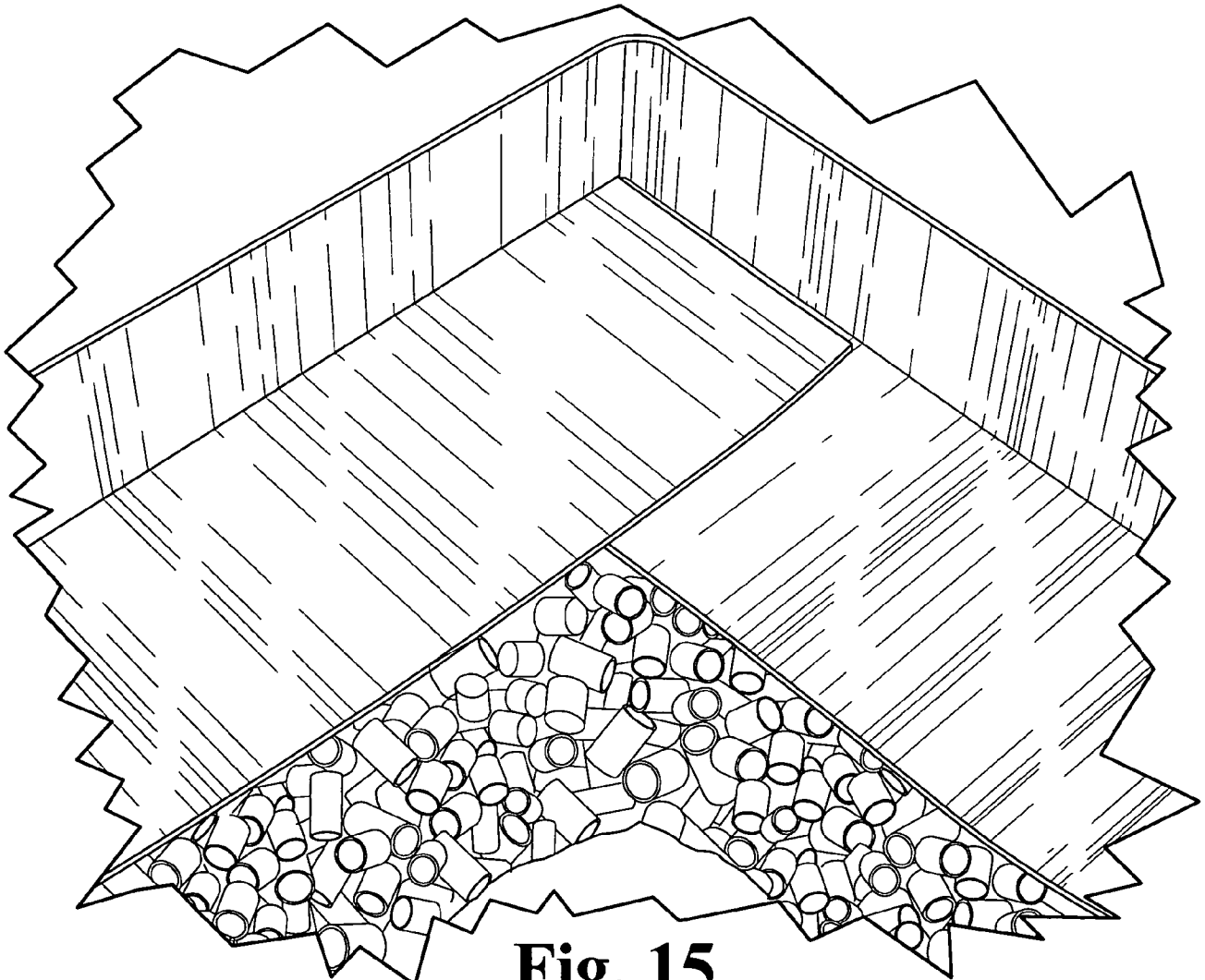
FIG. 15 shows another view of the embodiment of FIG. 14.

FIG. 14 shows a drainage trench that has been filled with drainpipe and synthetic rock. In this embodiment the synthetic rock comprises 100 pound psi ABS tubing that has been cut into sections approximately 1 to 3 inches in length. Cove Mold has been used to cover a portion of the trench before new concrete is poured. FIG. 15 shows another view of the embodiment of FIG. 14, particularly showing a finished corner before new concrete is poured.

In other embodiments the synthetic rocks may be used even when no drain tile is used. In such embodiments the drain tile may be used to at least partially fill in a drainage channel or trench to facilitate the long-term flow of water through the trench. When synthetic rocks are provided in the trench, dirt and debris will not fill the trench and restrict the flow of water. The synthetic rocks allow a flow of water through and around the rocks, thus facilitating the flow of water. Moreover, the synthetic rocks may support concrete or another floor material.

Figure 16:
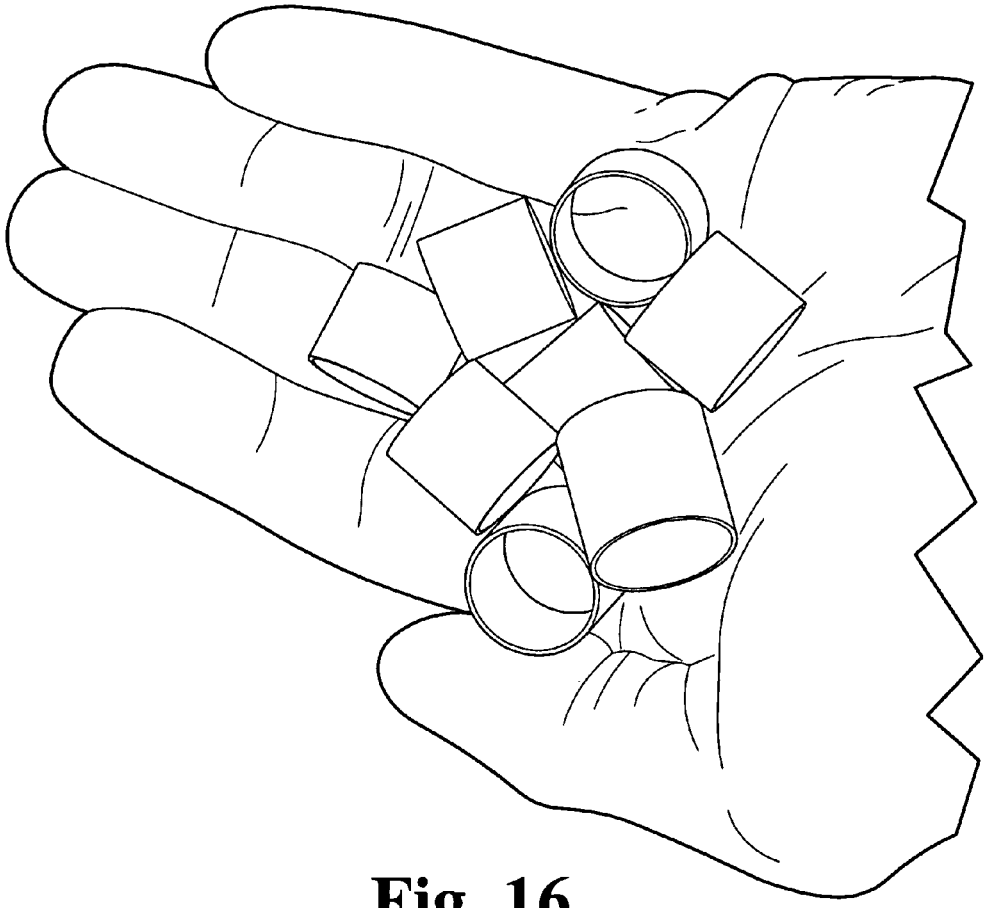
FIG. 16 shows another embodiment of the synthetic rocks that may be used in the methods of the present invention.
Figure 17:
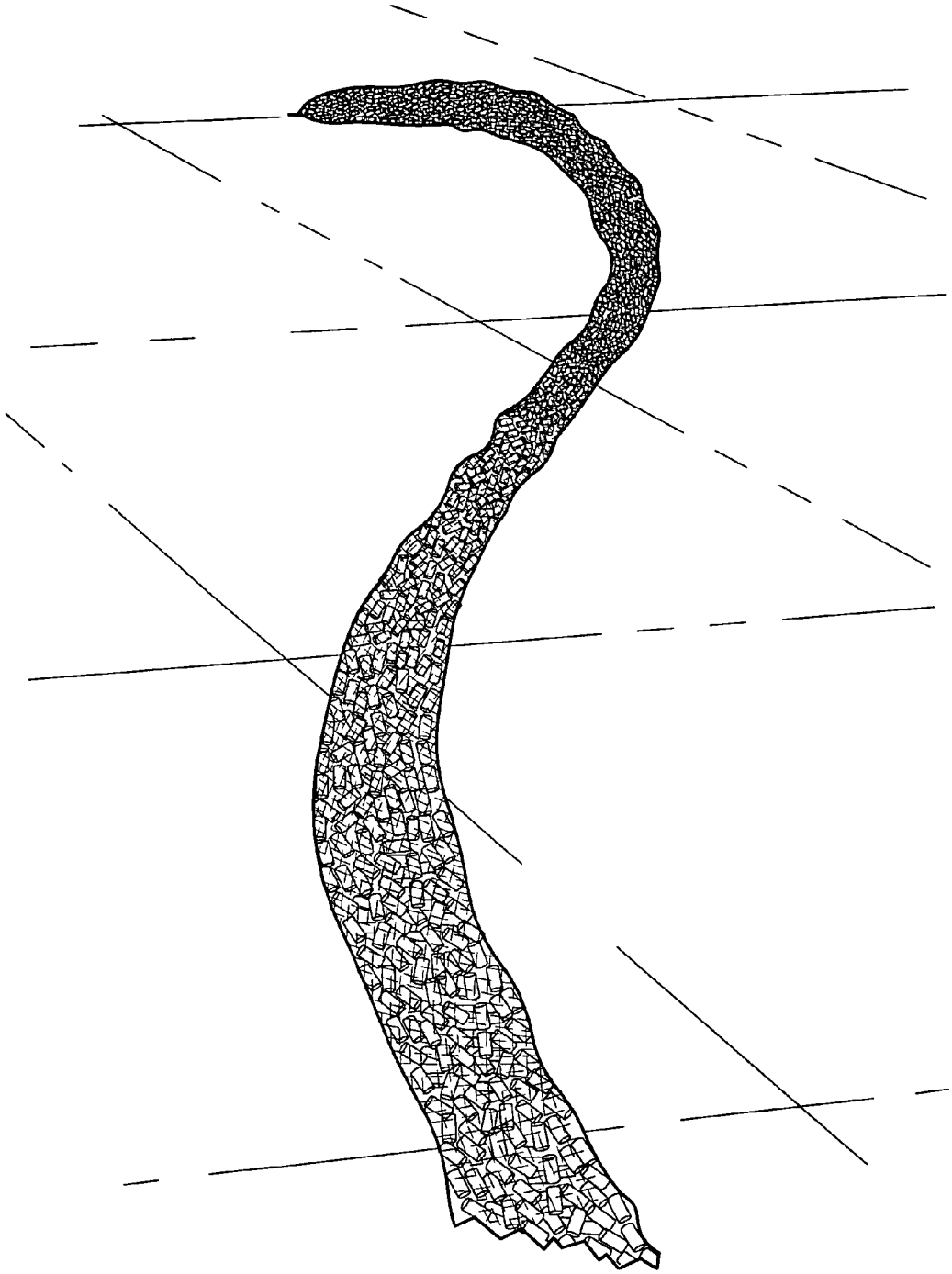
FIG. 17 shows the synthetic rocks of the present invention in mesh bags, such as may be used in a water flow path that does not include drain tile.

FIG. 16 shows synthetic rocks according to one preferred embodiment of the present invention. FIG. 17 shows another view of the synthetic rocks of FIG. 16, with the rocks being enclosed in a mesh bag to facilitate handling and installation.

In one preferred embodiment the synthetic pieces of the present invention are provided in mesh bags to facilitate their handling and use. Such mesh bags of synthetic rocks may be placed in water drainage trenches around perforated drain tile, or they may be used even when drain tile is not used. The bags of synthetic rock are particularly effective for facilitating water flow and for supporting a flooring material that may be used to cover the rocks. The mesh bags facilitate the handling of the synthetic pieces without unduly restricting the flow of water through the trench. The mesh bags also help control the placement and movement of the synthetic pieces—both during and after installation of the synthetic pieces.

The mesh bags may be of substantially any size and/or shape, with long, tubular bags effective for placement in a water drainage trench of the type disclosed herein being particularly preferred. In some preferred embodiments the mesh bags are between four and twelve inches in diameter, and are between five and twenty-five feet in length. The bags are preferably made of a water resistant material effective to prevent deterioration of the bags during long-term usage. The bags may be secured in place with fasteners, such as with heavy gauge poly vinyl straps or other fasteners located every three or four feet along the bag. Nails or other fasteners may also be used to secure the bags and/or its securing straps.

It is to be appreciated that the synthetic pieces of the present invention are particularly useful to facilitate the occasional flow of water in a drainage channel, such as in a water drainage system used to protect a building. Such water drainage system may be provided below the lowest floor of a building, such as below or in a crawl space. In some embodiments the drainage trench is at least ten feet long, and is preferably at least twenty feet long. The drainage trench may be lined, or it may be unlined.

It is also to be appreciated that the synthetic pieces of the present invention may be used with virtually any inside waterproofing system and/or method. For example, the synthetic rocks may be used alone, or they may be used in conjunction with cove molds, or with rounded, slotted, perforated, or filtered, channels or tiles. They may be used with baseboards, above grade, below grade, compacted, or loose. The synthetic rocks may be used in any manner in which standard gravel, limestone or river-gravel would be utilized in a water-control or waterproofing method.

It is also to be appreciated that the synthetic pieces of the present invention may be used with virtually any outside waterproofing system and/or method. Here too, the pieces may be installed alone or in conjunction with other methods, such as cove molds, tiles, rounded, slotted, perforated, filtered, channels, baseboards, above grade, below grade, compacted or loose. The synthetic pieces may be used wherever any standard gravel, limestone or river-gravel would be utilized in an outside water-control or waterproofing method.

It is also to be appreciated that the synthetic pieces of the present invention may be used with virtually any sub-grade French draining system in fields, yards, playgrounds, golf courses, farmland and/ or acreage, etc. The inventive pieces and methods may also be used in any erosion-control system, above surface or subsurface, alone or in conjunction with other water-control or waterproofing products and/or materials.

While the invention has been illustrated and described in detail in the drawings and foregoing description, the same is to be considered as illustrative and not restrictive in character, it being understood that all changes and modifications that come within the spirit of the invention are desired to be protected.

The invention claimed is:

1. A method of preventing water from seeping up through the floor of the lower level of a building, said method comprising:

a) providing a trench below the level of the floor of a building;

b) at least partially filling in said trench with a plurality of synthetic mini-tubes having a diameter of between 0.5 inches and 2.0 inches and a length of between 0.5 inches and 2.0 inches; and c) providing a solid flooring material over said synthetic mini-tubes to substantially cover said trench.

2. The method of claim 1, and further including the step of providing a semi-rigid support material over said synthetic mini-tubes before providing the solid flooring material.

3. The method of claim 1 wherein at least some of said synthetic mini tubes are contained in a mesh bag to facilitate placement of the pieces.

4. The method of claim 1, and further including providing perforated or slotted drain tile in said trench to facilitate draining water from the building.

* * * * *